US007777141B2

(12) United States Patent
Ishiguro

(10) Patent No.: US 7,777,141 B2
(45) Date of Patent: Aug. 17, 2010

(54) LATCH-RELEASE ACTUATING APPARATUS

(75) Inventor: Katsuyuki Ishiguro, Yamanashi (JP)

(73) Assignee: Mitsui Mining & Smelting Co., Ltd., Tokyo (JP)

( * ) Notice: Subject to any disclaimer, the term of this patent is extended or adjusted under 35 U.S.C. 154(b) by 488 days.

(21) Appl. No.: 11/822,826

(22) Filed: Jul. 10, 2007

(65) Prior Publication Data

US 2008/0034821 A1 Feb. 14, 2008

(30) Foreign Application Priority Data

Aug. 9, 2006 (JP) ..... 2006-217032

(51) Int. Cl.
*H01H 9/02* (2006.01)

(52) U.S. Cl. ..... 200/61.52; 200/341; 200/510; 200/302.2

(58) Field of Classification Search ..... 200/61.62, 200/61.85, 293, 302.2, 320, 321, 329–332, 200/341–345, 510, 520–523; 292/346–348, 292/356, DIG. 37

See application file for complete search history.

(56) References Cited

U.S. PATENT DOCUMENTS 6,576,854 B2 6/2003 Yamanaka et al.

6,626,473 B1 * 9/2003 Klein et al. ..... 200/302.2

FOREIGN PATENT DOCUMENTS

GB 2 140 623 A 11/1984
JP 2002-175736 A 6/2002

* cited by examiner

*Primary Examiner*—Renee S Luebke
*Assistant Examiner*—Marina Fishman
(74) *Attorney, Agent, or Firm*—Foley & Lardner LLP

(57) ABSTRACT

A latch-release actuating apparatus includes a switch element, a base member, and a cover member. The switch element is depressed via the cover member. In the latch-release actuating apparatus, a key top member and the cover member are formed to be long to extend horizontally from an upper region of the push button. The key top member is arranged on a back surface of the cover member so that a longitudinal direction of the key top member coincides with a longitudinal direction of the cover member. Furthermore, claws and retaining portions to which the claws are retained are arranged between the base member and both longitudinal ends of the key top member, thereby constituting a regulating unit for restricting separation of the key top member from the push button when the claw abuts on the retaining portion.

17 Claims, 14 Drawing Sheets

LATCH-RELEASE ACTUATING APPARATUS

This application claims priority from Japanese Patent Application No. 2006-217032, filed Aug. 9, 2006, which is incorporated herein by reference in its entirety.

BACKGROUND OF THE INVENTION

1. Field of the Invention

The present invention relates to a latch-release actuating apparatus for releasing a latched state of a trunk lid of a vehicle.

2. Description of the Related Art

Some vehicles are designed to drive a release actuator if a latched state of a trunk lid is to be released. A latch-release actuating apparatus applied to a vehicle includes a switch element for driving the release actuator. The switch element includes a push button and a switch main body. The switch element is configured to transmit an output signal for driving the release actuator when the push button is depressed against the switch main body to switch on.

Furthermore, the latch-release actuating apparatus is provided with a base member and a cover member. The base member holds the switch element so that the push button faces a surface of the base member. The cover member, which is made of an elastic material such as rubber, is arranged on the base member so as to cover up the push button.

In the vehicle including the latch-release actuating apparatus, if an operator depresses the switch element via the cover member, the release actuator is driven to release the latched state of the trunk lid as disclosed in, for example, Japanese Patent Application Laid-Open No. 2002-175736.

Meanwhile, the latch-release actuating apparatus for releasing the latched state of the trunk lid is generally arranged on a top of a concave portion which is directed to a front side of the vehicle and formed in an outer door panel of the trunk lid. If the latch-release actuating apparatus is arranged at that location, the operator normally cannot recognize the latch-release actuating apparatus visually and operates it based on tactile sensation.

To improve operability of such a latch-release actuating apparatus, there is an idea that a long cover member is formed so as to extend horizontally from an upper region of the push button.

However, if the cover member is formed simply as stated above, there is a possibility of having a problem that, if the operator operates an end of a cover member made of the elastic material such as rubber, the push button cannot be depressed against the switch main body with only a deformation of the cover member, and the latched stated of the trunk lid cannot be released.

SUMMARY OF THE INVENTION

It is an object of the present invention to at least partially solve the problems in the conventional technology.

A latch-release actuating apparatus according to one aspect of the present invention includes: a switch element that is turned on to release a latched state of a trunk lid when a push button is depressed against a switch main body; a base member that includes a concave portion which therein accommodates the switch element; and a cover member that has a water-tightness and covers up the concave portion, wherein the switch element is depressed via the cover member, a key top member and the cover member are formed to be long to extend horizontally from an upper region of the push button, the key top member is arranged on a back surface of the cover member so that a longitudinal direction of the key top member coincides with a longitudinal direction of the cover member, and claws and retaining portions to which the claws are retained are arranged between the base member and longitudinal ends of the key top member, thereby constituting a regulating unit for regulating a separation of the key top member from the push button when the claws abut on the retaining portions.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a latch-release actuating apparatus according to the present invention will be described in detail below with reference to the accompanying drawings.

Figure 1:
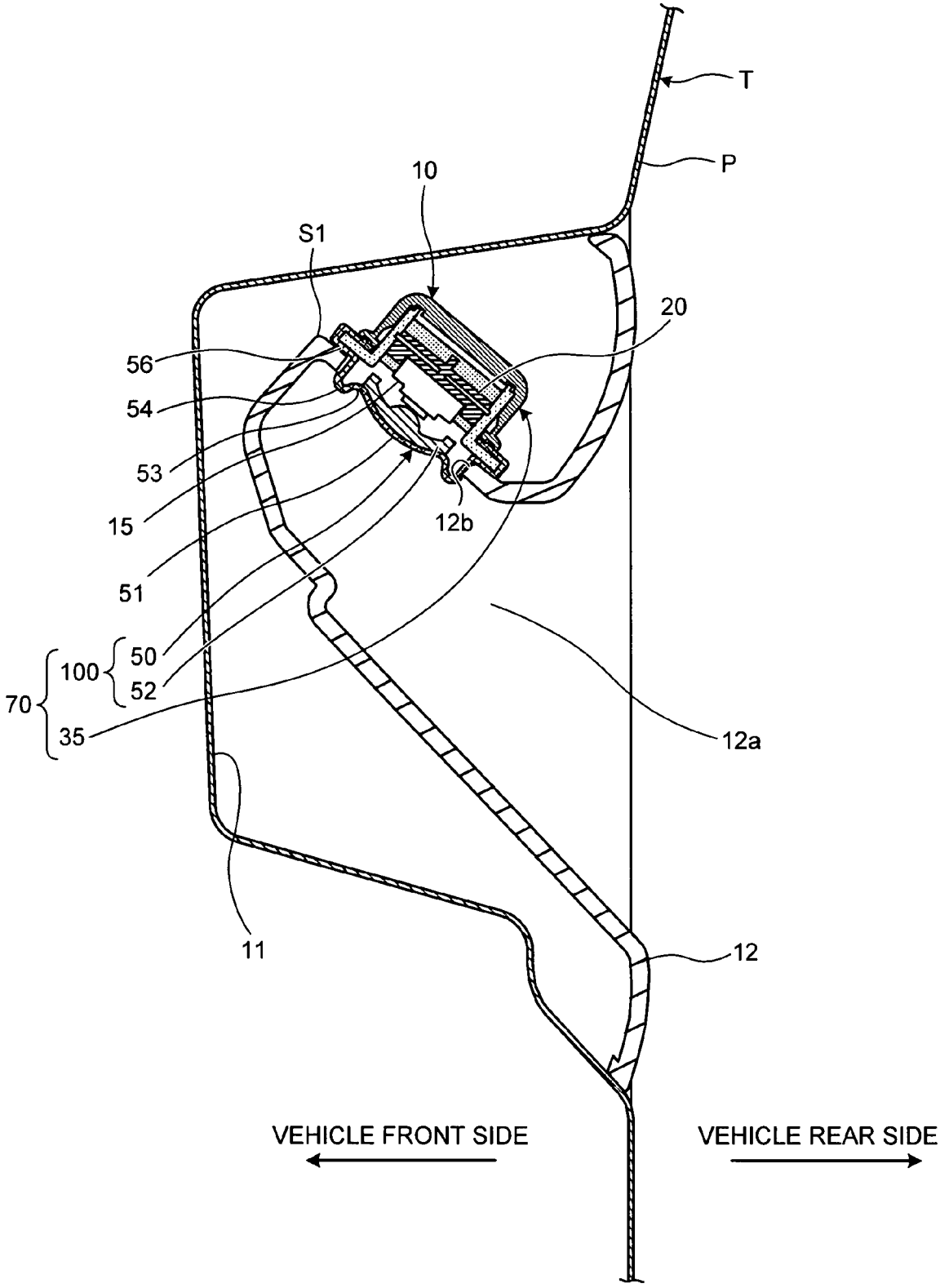
FIG. 1 is a cross-sectional side view showing principal parts of a vehicle to which a latch-release actuating apparatus according to an embodiment of the present invention is applied.

FIG. 1 shows principal parts of a vehicle to which a latch-release actuating apparatus according to an embodiment of the present invention is applied. The latch-release actuating apparatus shown in FIG. 1 is designed to open or close a trunk room of a vehicle, e.g., a four-wheel-drive vehicle.

A latch-release actuating apparatus 10 is provided in a concave portion 11 formed at a door outer panel P of a trunk lid T and attached to the door outer panel P via an attachment member 12.

The concave portion 11 is formed to be directed to a front side of the vehicle. The attachment member 12 made of resin material is formed to cover up the concave portion 11, and includes an operation concave portion 12*a*, an attachment opening 12*b*, and screw clamp protrusions 12*c* and 12*d*.

Figure 2:
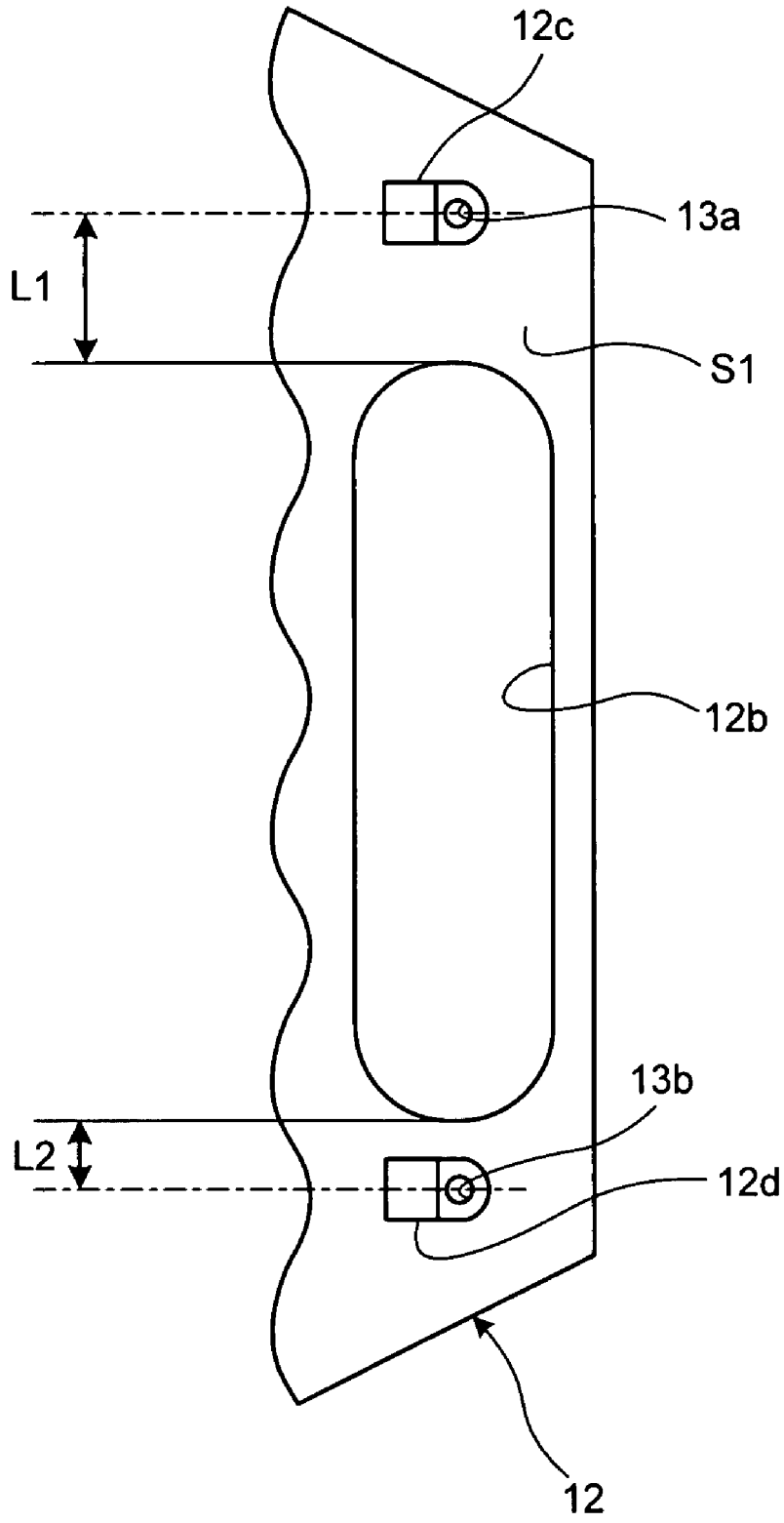
FIG. 2 is a schematic diagram of a part of an attachment member included in the vehicle.

The operation concave portion 12*a* is formed to be directed obliquely upward. The attachment opening 12*b* is arranged on the attachment member 12 to be located at a top portion of the operation concave portion 12*a* as shown in FIGS. 1 and 2. The attachment opening 12*b* is formed to be elongated in a width direction orthogonal to a longitudinal direction of the vehicle. The attachment opening 12*b* has a size which thereinto allows inserting a lip portion 54, a groove 53, and an operating portion 51 of a cover member 50, to be described later, and abutting of a surface side of a circumference of the cover member 50 on an inside surface S1 of the attachment member 12.

The screw clamp protrusions 12*c* and 12*d* have screw holes 13*a* and 13*b*, respectively. When a length from a center of the upper screw hole 13*a* to one end of the attachment opening 12*b* is L1 and a length from a center of the lower screw hole 13*b* to the other end of the attachment opening 12*b* is L2 in FIG. 2, the screw clamp protrusions 12*c* and 12*d* are arranged so that the length L1 is larger than the length L2 and the attachment opening 12*b* is put between the screw clamp protrusions 12*c* and 12*d*.

As shown in FIGS. 3 to 6, the latch-release actuating apparatus 10 includes a switch element 15, a substrate 20, a case 35, and a lid member 100. The substrate 20 and the case 35 constitute a base member 18, the base member 18 and the lid member 100 constitute a housing 70, and the switch element 15 and the substrate 20 are arranged inside the housing 70.

The switch element 15, which is a so-called tact switch, includes a switch main body 16 and a push button 17. In the embodiment, the switch element 15 in which the switch main body 16 has substantially square and thin outer shape, and the push button 17 having a thin cylindrical shape protrudes from an upper surface of the switch main body 16 is employed.

The switch element 15 is normally kept turned off. If the push button 17 is depressed against the switch main body 16, the switch element 15 is turned on. Thereafter, if the depression force of the push button 17 is eliminated, the push button 17 makes a returning movement by an action of a return spring which is included in the switch element 15 though not shown, and the switch element 15 is turned off again. The switch element 15 is configured so that the push button 17 can be depressed against the switch main body 16 only with a depression stroke.

As shown in FIGS. 7 to 12, the substrate 20 is formed into a plate which includes a first semicircular portion 21, a rectangular portion 22, and a second semicircular portion 23. The substrate 20 is provided with a first leg 24, a second leg 25, a third leg 26, a fourth leg 27, a fifth leg 28, and protection walls 30.

Figure 6:
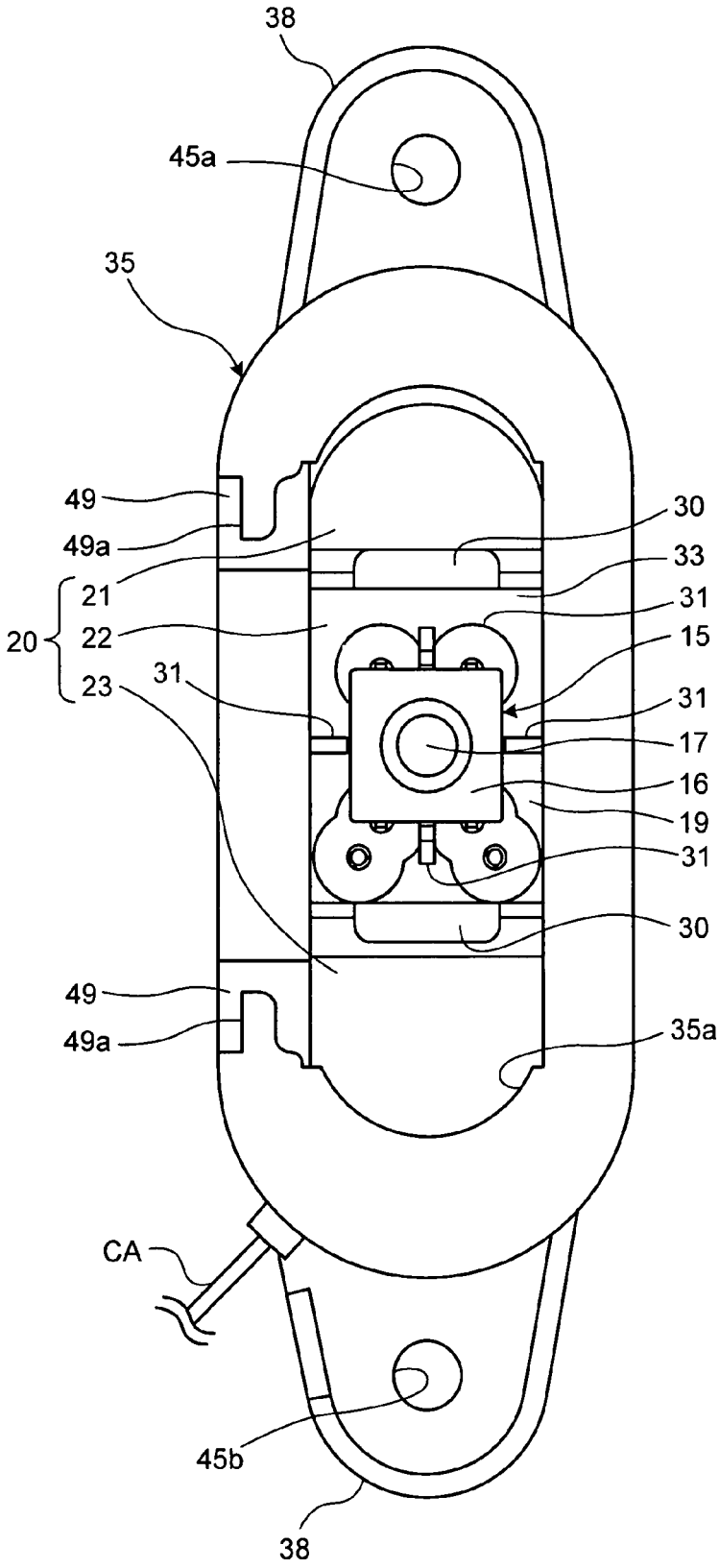
FIG. 6 is a front view of the latch-release actuating apparatus, illustrating a state where a cover member is detached from the latch-release actuating apparatus.
Figure 7:
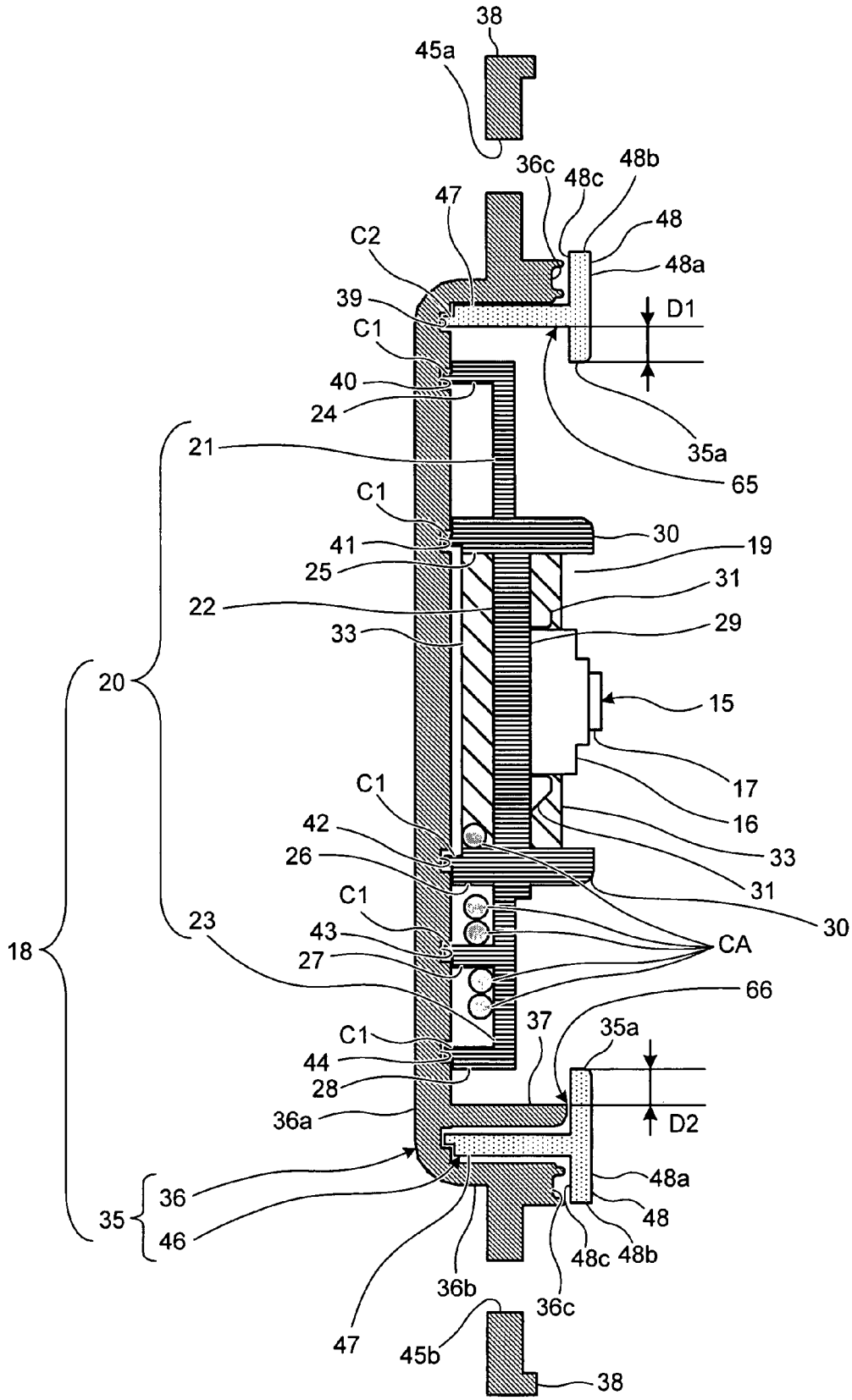
FIG. 7 is a cross-sectional view of a case included in the latch-release actuating apparatus shown in FIG. 1.

The first semicircular portion 21 located on the upper side of the substrate 20 in FIG. 7 is formed into a semicircle as shown in FIG. 6. The rectangular portion 22 located at the center of the substrate 20 in FIG. 7 is formed to be connected to the first semicircular portion 21 in a rectangle shape as shown in FIG. 6. The rectangular portion 22 includes a concave portion 19 which accommodates the switch element 15 therein on a surface side of the rectangular portion 22. The second semicircular portion 23 located on the lower side of the substrate 20 in FIG. 7 is formed to be connected to the rectangular portion 22 in a semicircle shape as shown in FIG. 6.

As shown in FIGS. 7 to 12, each of the legs 24, 25, 26, 27, and 28 has an engagement claw C1 at its tip end and protrudes toward a back surface side of the substrate 20. The first leg 24 is formed along an edge of the first semicircular portion 21 and arc-shaped in a bottom view.

The second leg 25 is formed to be linear in the bottom view at a predetermined distance from the first leg 24.

The third leg 26 is formed to be linear in the bottom view at a predetermined distance from the second leg 25. The third leg 26 is provided with a cable-insertion hole H1.

The fourth leg 27 is formed to be linear in the bottom view at a predetermined distance from the third leg 26. The fourth leg 27 is provided with a cable-insertion cut H2 on one side end.

The fifth leg 28 is formed along an edge of the second semicircular portion 23 and arc-shaped in the bottom view. The fifth leg 28 is provided with a cable-insertion cut H3 on the other side end of the H2.

The concave portion 19 is arranged at almost central portion in the longitudinal direction of the substrate 20. The concave portion 19 is larger than the switch element 15 in longitudinal size and vertical size. The concave portion 19 has a switch mounting portion 29. The switch mounting portion 29 is arranged at the center of the concave portion 19 and slightly larger than the switch element 15 in longitudinal size and vertical size. Terminal penetrating holes, not shown, are formed at appropriate portions of the switch mounting portion 29 so that terminals of the switch element 15 penetrates toward the back side of the substrate 20.

As shown in FIG. 6, the switch mounting portion 29 is provided with four positioning ribs 31, which protrude from the front side surface of the substrate 20 and surround the switch mounting portion 29.

The positioning ribs 31 abut on a periphery of the switch main body 16, thereby positioning the switch element 15 with respect to the substrate 20.

The protection walls 30, which constitute the concave portion 19, are arranged near the switch mounting portion 29 so that the switch mounting portion 29 is placed therebetween in the vertical direction in FIG. 6. As shown in FIG. 7, the protection walls 30 are formed to protrude toward the front surface side of the substrate 20. A protrusion length of the protection walls 30 toward the substrate 20 is slightly smaller than the protrusion length of the push button 17 toward the substrate 20. Furthermore, a protrusion amount of the protection walls 30 is set so that a gap between an abutment concave portion 52*a* formed in a key top member 52 to be described later, and a tip end of the protection wall 30 is smaller than the depression stroke of the switch element 15 in a state where the base member 18 and the lid member 100 constitute the housing 70.

As shown in FIG. 7, the case 35, which is made of a relatively hard synthetic resin having an electrical insulation property, includes a case main body 36 and a collar 46.

Figure 13:
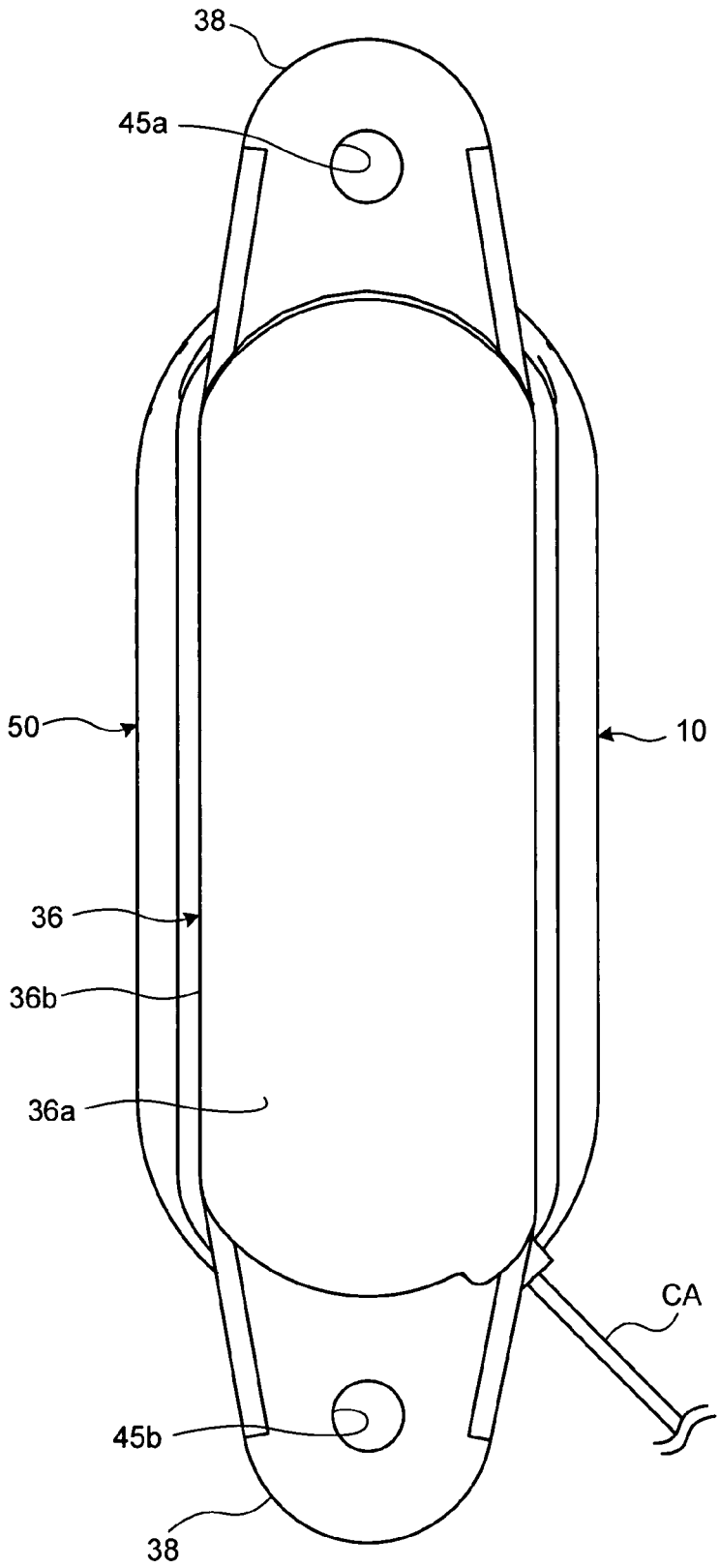
FIG. 13 is a bottom view of the latch-release actuating apparatus shown in FIG. 1.

As shown in FIG. 13, the case main body 36 is formed so that the vertical length is larger than the horizontal length, and is formed into a box shape having an opening formed in an upper surface thereof so as to accommodate therein the substrate 20. As shown in FIG. 7, the case main body 36 includes an engagement wall 37 inside and two tongue-shaped portions 38 outside.

Figure 9:
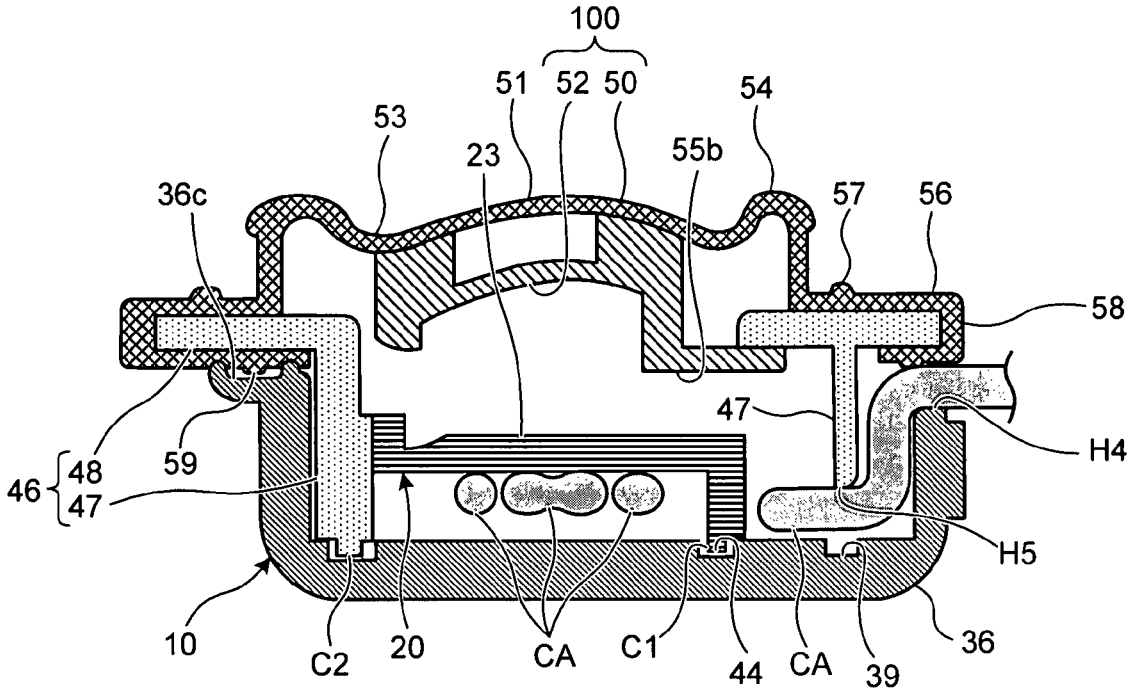
FIG. 9 is a cross-sectional view taken along a line II-II of FIG. 8.
Figure 10:
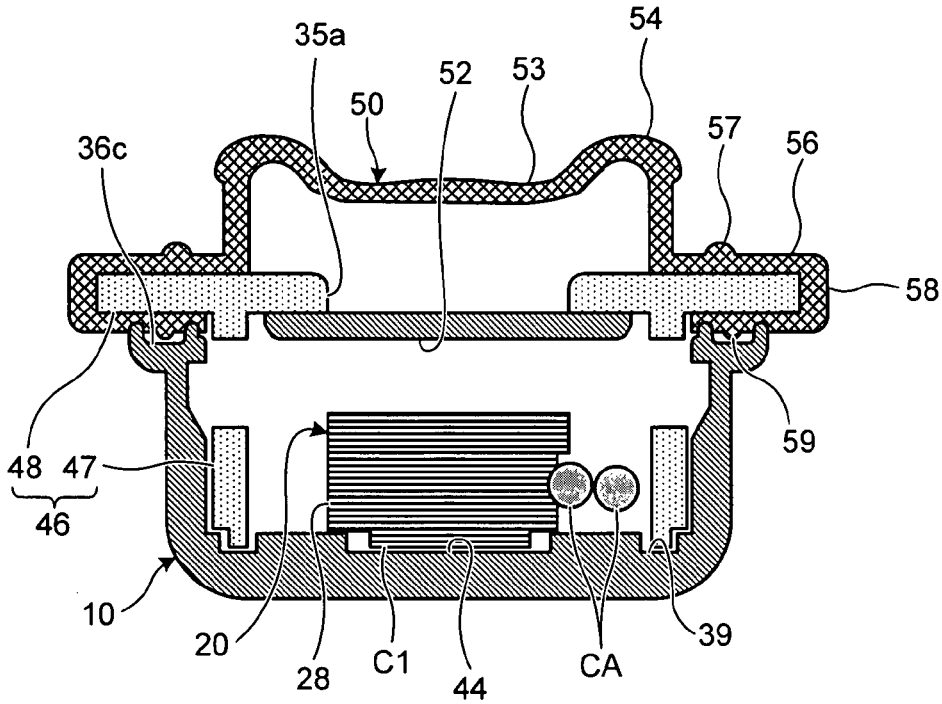
FIG. 10 is a cross-sectional view taken along a line III-III of FIG. 8.

An engagement groove 36*c* is formed on an upper end of a sidewall 36*b* of the case main body 36 along a peripheral edge of the opening of the case main body 36. Furthermore, as shown in FIG. 9, the sidewall 36*b* of the case main body 36 is provided with a cable-insertion cut H4 which allows a cable CA to extend from the inside to the outside of the casing 70.

As shown in FIG. 7, a peripheral-edge engagement groove 39, a first engagement groove 40, a second engagement groove 41, a third engagement groove 42, a fourth engagement groove 43, and a fifth engagement groove 44 are formed in a bottom wall 36*a* inside of the case main body 36. The peripheral-edge engagement groove 39 is formed along an edge of the bottom wall 36*a*.

The first engagement groove 40 is formed to be arc-shaped in a plan view so as to correspond to the first leg 24 of the substrate 20.

The second engagement groove 41 is formed to be linear in the plan view so as to correspond to the second leg 25 of the substrate 20.

The third engagement groove 42 is formed to be linear in the plan view so as to correspond to the third leg 26 of the substrate 20.

The fourth engagement groove 43 is formed to be linear in the plan view so as to correspond to the fourth leg 27 of the substrate 20.

The fifth engagement groove 44 is formed to be arc-shaped in the plan view so as to correspond to the fifth leg 28 of the substrate 20.

The engagement wall 37 is formed to protrude upward from the bottom wall 36*a* along the sidewall 36*b*.

The tongue-shaped portions 38 are formed to extend in an orthogonal direction to the sidewall 36*b* of the case main body 36. As shown in FIGS. 7 and 13, the tongue-shaped portions 38 are provided with penetrating holes 45*a* and 45*b* so that the penetrating holes 45*a* and 45*b* penetrate the tongue-shaped portions 38, respectively.

Figure 12:
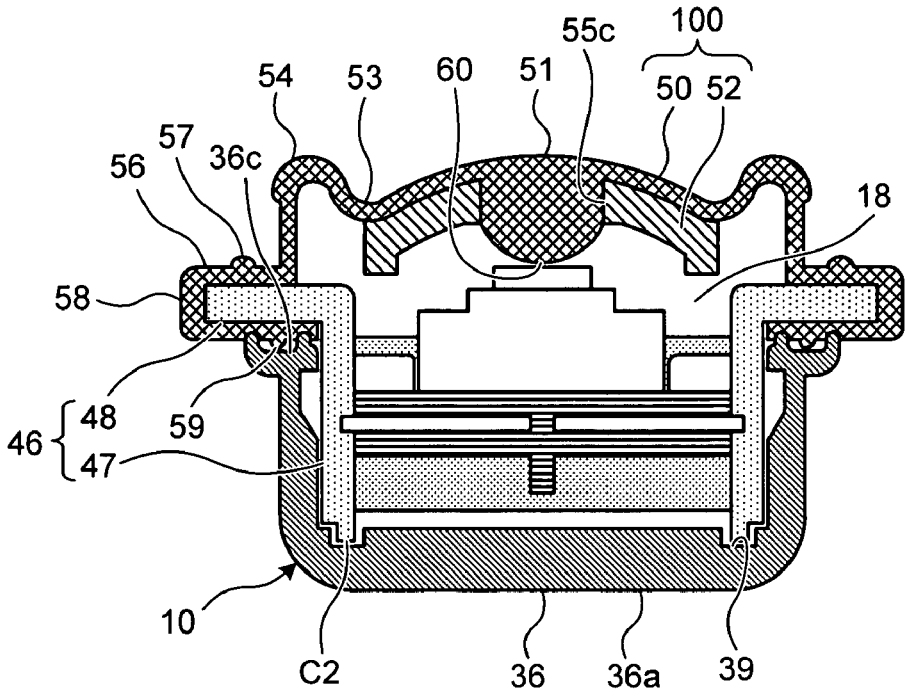
FIG. 12 is a cross-sectional view taken along a line V-V of FIG. 8.

The collar 46 is made of a relatively hard synthetic resin having an electrical insulation property. As shown in FIG. 12, the collar 46 includes a first plate member 47 and a second plate member 48.

Figure 8:
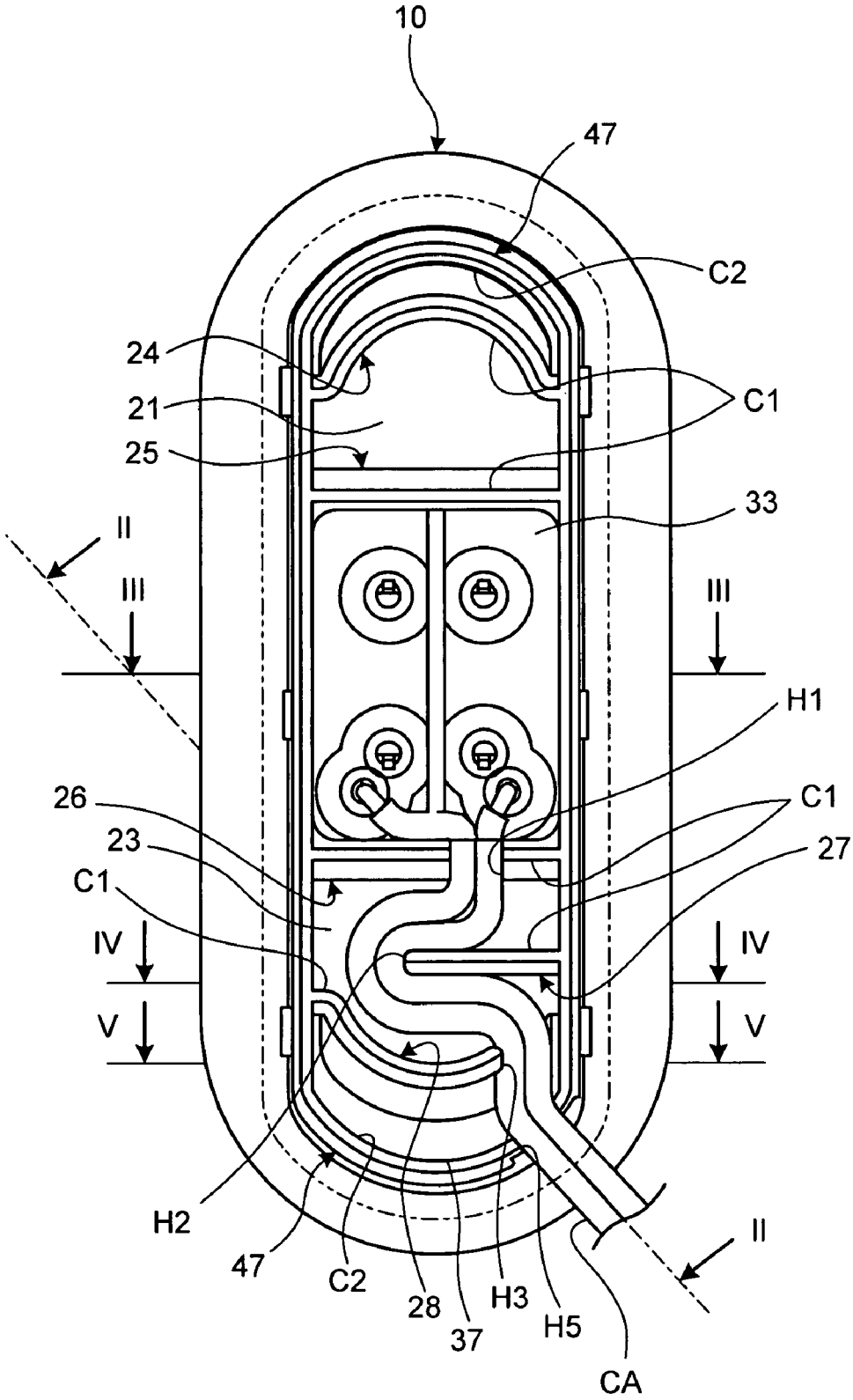
FIG. 8 is a schematic diagram of an interior of the latch-release actuating apparatus shown in FIG. 1.

The first plate member 47 is formed into a plate shape along the peripheral-edge engagement groove 39 of the bottom wall 36*a*, and includes an engagement claw C2 formed at its tip end to be engaged with the peripheral-edge engagement groove 39. The first plate member 47 constitutes the concave portion 19. As shown in FIGS. 8 and 9, the first plate member 47 is provided with a cable-insertion cut H5.

As shown in FIG. 12, the second plate member 48 is formed to extend from one end of the first plate member 47 toward a direction orthogonal to the first plate member 47. The second plate member 48 constitutes the concave portion 19. The collar 46 including the first plate member 47 and the second plate member 48 has a T-shaped cross section in a larger-length direction of the case main body 36 and has an L-shaped cross section in a smaller-length direction thereof.

As shown in FIG. 6, two breathing grooves 49 are formed on an upper end of the second plate member 48 across the second plate member 48. A trap 49*a* is formed halfway along each breathing groove 49 to reduce an area of the breathing groove 49. In the embodiment, the collar 46 is formed integrally with the substrate 20.

Next, a method of assembling an integrated member of the collar 46 and the substrate 20, the switch element 15, and the case 35 will be described.

First, the switch element 15 is mounted on the switch mounting portion 29 of the substrate 20 while being positioned by the positioning ribs 31 shown in FIG. 7. Thereafter, a sealing material is filled into the concave portion 19 so as to cover up a lower half of the switch main body 16. The sealing material is then hardened, thereby providing a seal member 33 which seals an electrically-conductive portion on the front surface side of the substrate 20. The switch element 15 is attached onto the substrate 20 by the seal member 33. The sealing material is, for example, a resin having an electrical insulation property and a waterproof property.

Next, after one end of the cable CA whose outer skin is partially removed is inserted into the cable-insertion cut H5 provided to the first plate member 47, the cut H3 provided to the fifth leg 28, the cut H2 provided to the fourth leg 27, and the cable-insertion hole H1 provided to the third leg 26, the cable CA is soldered to a terminal on the back surface side of the substrate 20. One end of the cable CA is connected to the terminal at the back surface side of the substrate 20, so that the terminal is electrically connected to a connector CO attached to the other end of the cable CA shown in FIG. 4.

A sealing resin similar to the above-stated sealing material is filled into a space surrounded by the back surface of the substrate 20, the first plate member 47 of the collar 46, the second leg 25, and the third leg 26 shown in FIG. 7 so as to cover the terminal on the back surface side of the substrate 20 with the sealing resin. Thereafter, the sealing resin is hardened, thereby providing the sealing member 33 which seals the terminal of the switch element 15 and the electrically-conductive portions, e.g., a soldered portion on the back surface side of the substrate 20. Accordingly, the electrically-conductive portions on the front and back surfaces of the substrate 20 are sealed with the seal member 33 in the latch-release actuating apparatus 10 in the embodiment.

After inserting the cable CA into the cable-insertion cut H5 provided to the case main body 36, the engagement grooves 40, 41, 42, 43, and 44 provided on the bottom wall 36*a* of the case main body 36 are engaged with the corresponding engagement claws C1 provided to the legs 24, 25, 26, 27, and 28 of the substrate 20, respectively. Moreover, the collar 46 and the substrate 20 are attached to the case main body 36 so as to engage the peripheral-edge engagement groove 39 provided on the bottom wall 36*a* of the case main body 36 with the engagement claw C2 provided on the collar 46. By doing so, the integrated member of the substrate 20 and the collar 46 is attached to the case main body 36 to constitute the case 35. The case 35 as stated above has an opening 35*a*, which is long in the larger-length direction of the case main body 36 and short in the smaller-length direction thereof in an upper surface of the case 35.

Figure 5:
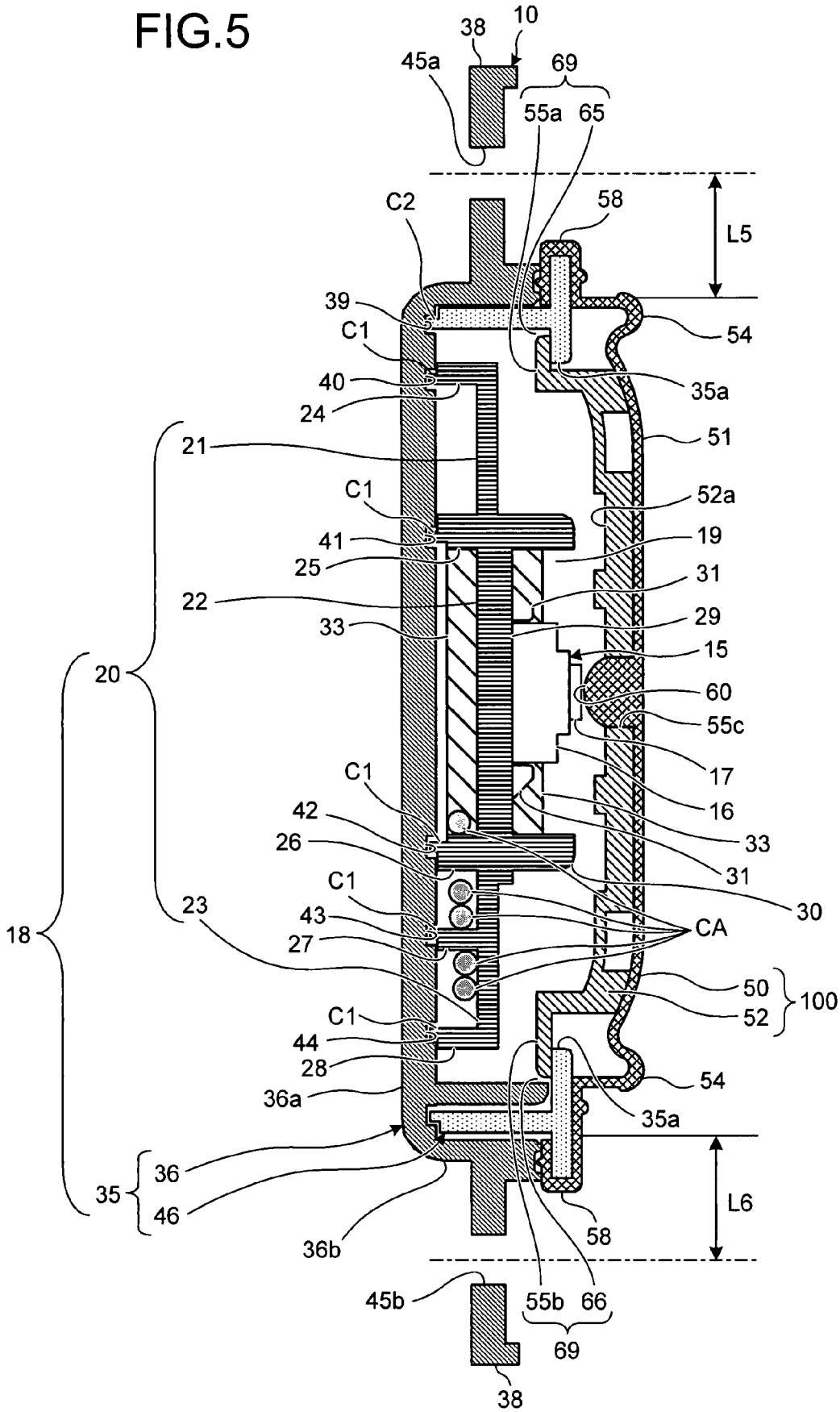
FIG. 5 is a cross-sectional view taken along a line I-I of FIG. 4.

As shown in FIG. 7, when a depth of a first retaining portion 65 located on one end of the opening 35*a* in the longer-length direction and constituted by the first plate member 47 and the second plate member 48 is D1, and a depth of a second retaining portion 66 located on the other end of the opening 35*a* and constituted by the engagement wall 37 and the second plate member 48 is D2, the case 35 is formed so that the depth D1 of the first engagement concave portion is smaller than the depth D2 of the second engagement concave portion. As shown in FIG. 5, retaining claws 55*a* and 55*b*, and the first retaining portion 65 and the second retaining portion 66 constitutes a regulating unit 69.

Figure 14:
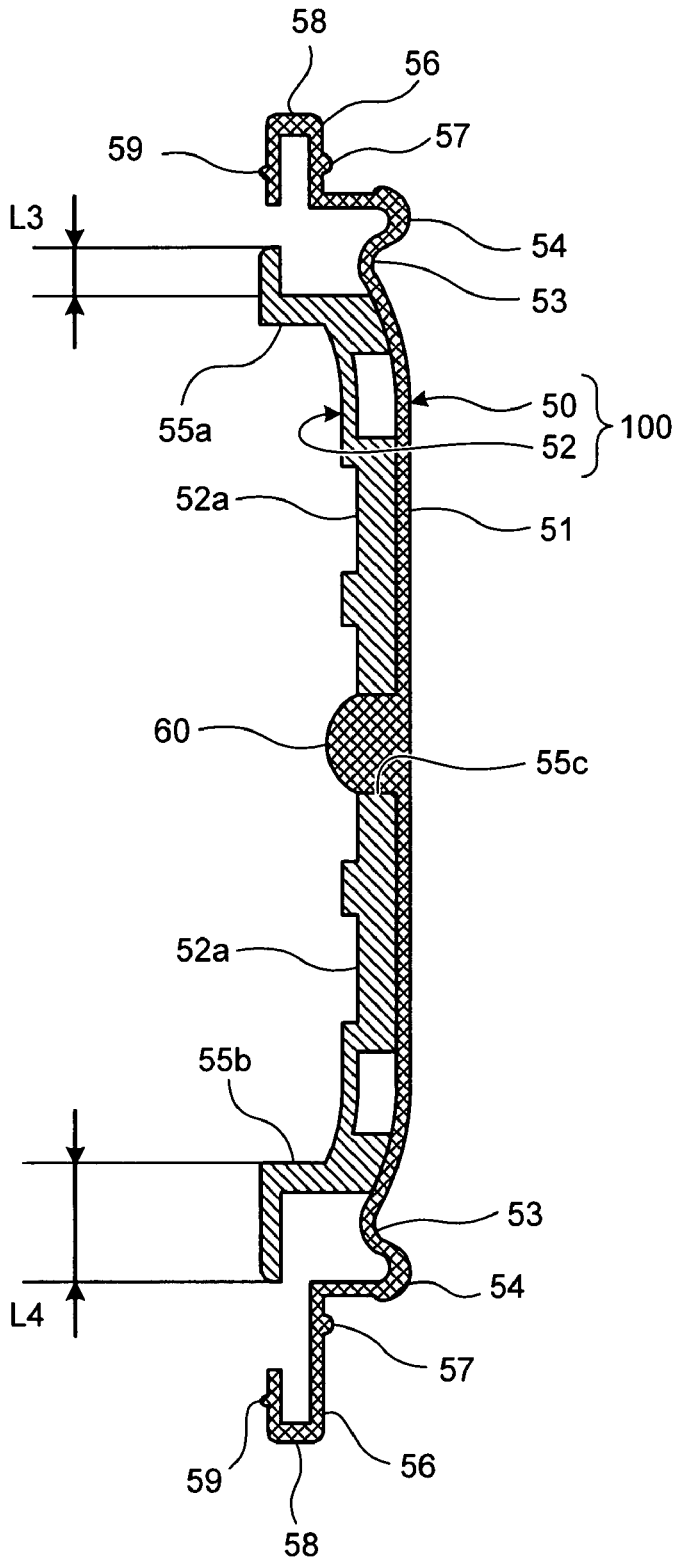
FIG. 14 is a cross-sectional view of the cover member included in the latch-release actuating apparatus shown in FIG. 1.

A configuration of the lid member 100 will be described next. As shown in FIG. 14, the lid member 100 includes the key top member 52 and the cover member 50. The cover member 50 is made of a material having water tightness and elasticity, e.g., a rubber such as an ethylene-propylene rubber, and includes a groove 53, a lip portion 54, a peripheral edge 56, an attachment portion 58, and a pressing portion 60. As shown in FIGS. 1, 5, and 12, the cover member 50 is formed to be long to extend horizontally from an upper region of the push button 17 in the state where the base member 18 and the lid member 100 constitute the housing 70. The key top member 52 is made of a synthetic resin relatively harder than the cover member 50. In the lid member 100 according to the embodiment, the key top member 52 and the cover member 50 are manufactured integrally with each other by an insert molding so that a longitudinal direction of the key top member 52 coincides with that of the cover member 50 and so that the key top member 52 is arranged on a back surface side of the cover member 50.

As shown in FIGS. 5 and 12, the key top member 52 is formed into a long plate shape so as to extend horizontally from the upper region of the push button 17 in the state in which the base member 18 and the lid member 100 constitute the housing 70. The key top member 52 is arranged on a back surface of the operating portion 51 so as to also cover up the protection wall 30. Moreover, the key top member 52 is almost identical in horizontal size and vertical size to the operating portion 51. An abutment concave portion 52*a* is formed to be opposed to a tip end of the protection wall 30 in the state where the base member 18 and the lid member 100 constitute the housing 70.

The retaining claws 55*a* and 55*b* engaged with the first retaining portion 65 and the second retaining portion 66 are provided on both ends of the key top member 52, respectively. The retaining claws 55*a* and 55*b* extend in the direction of the back surface of the key top member 52 and then in opposite directions so that the retaining claws 55*a* and 55*b* are apart from each other. In the embodiment, a protrusion length L3 of the retaining claw 55*a* whose tip end extends to the upward direction is smaller than a protrusion length L4 of the retaining claw 55*b* whose tip end extends to the downward direction in FIG. 14.

Furthermore, a circular penetrating hole 55*c* is provided at the center of the key top member 52 and at a position corresponding to the push button 17 of the switch element 15. The pressing portion 60 is fitted into the penetrating hole 55*c*.

Figure 4:
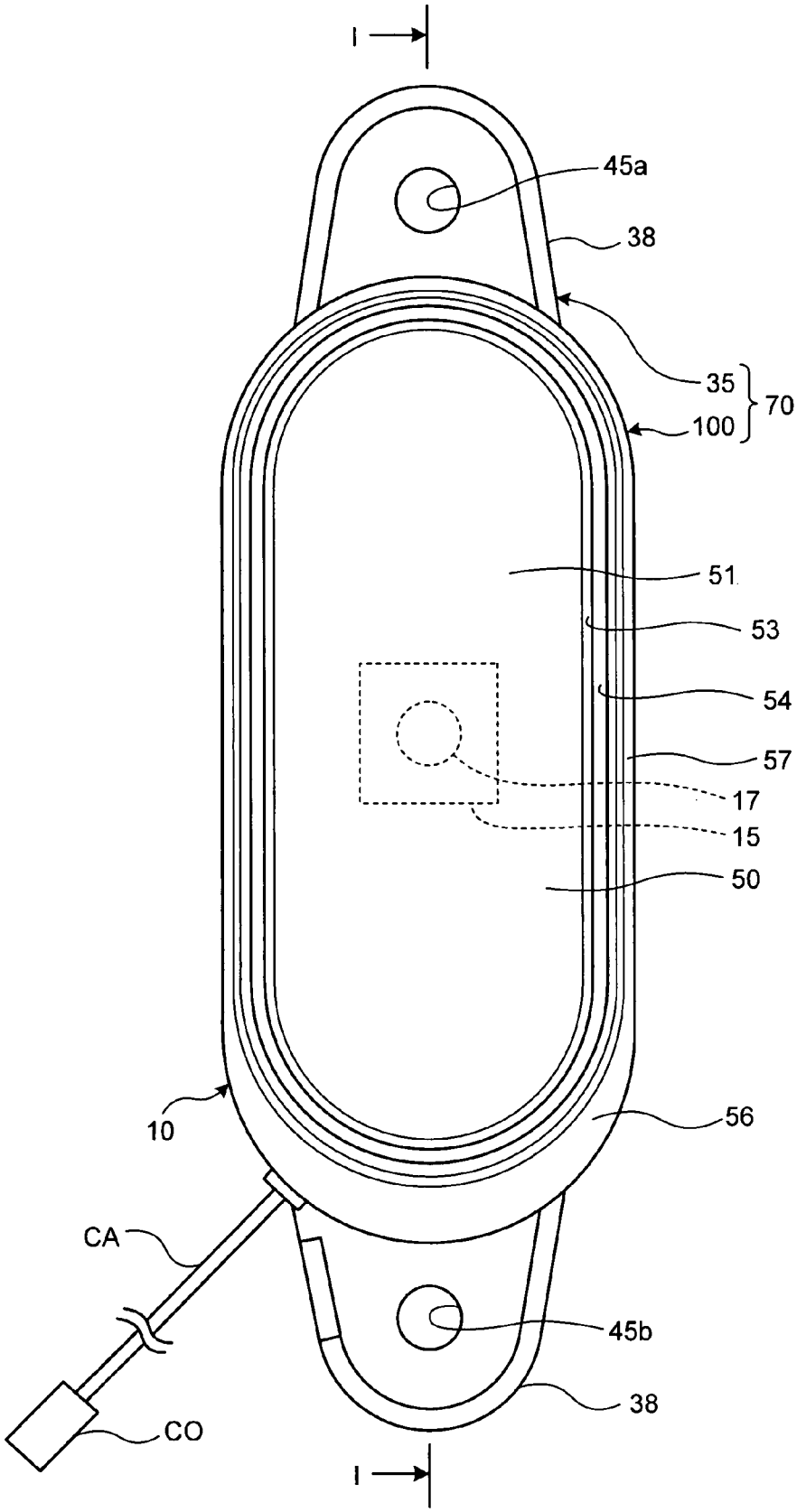
FIG. 4 is a front view of the latch-release actuating apparatus shown in FIG. 1.

The operating portion 51 is configured to be large enough to cover up a region corresponding to the switch element 15, i.e., the upper region of the switch element 15 and the opening 35*a* of the case 35. The operating portion 51 is configured so as to be larger in horizontal size and vertical size than the switch element 15, thereby making an operative area larger than that of the push button 17 of the switch element 15 and improving operability. Besides, as shown in FIG. 4, if the operating portion 51 is formed so that the vertical length is larger than the horizontal length, and arranged to be elongated with respect to the width direction orthogonal to the longitudinal direction of the vehicle when the housing 70 is attached to the trunk lid T of the vehicle, the operability is further improved.

The pressing portion 60 is arranged in a region corresponding to the switch element 15 on the back surface of the cover member 50. The pressing portion 60 is formed to be circular in a plan view and to have the center of the pressing portion 60 protruding toward the back surface side of the cover member 50 in a side view.

The groove 53 is formed in the circumference of the operating portion 51 so as to be integral with the operating portion 51. The groove 53 is depressed downward with respect to the operating portion 51 and formed in a borderless state.

The lip portion 54 is provided on a circumference of the groove 53 so as to be integral with the groove 53. The lip portion 54 protrudes upward with respect to the groove 53, has a semicircular cross section, and is formed in the borderless state. A height of the lip portion 54 is almost the same as that of the operating portion 51.

The peripheral edge 56 covers up a surface 48*a* of the second plate member 48 shown in FIG. 7, and formed to be integral with the circumference of the lip portion 54. As shown in FIG. 14, a first protrusion 57 is formed on the peripheral edge 56 along the lip portion 54. The first protrusion 57 has a semicircular cross section and is formed in the borderless state.

Figure 3:
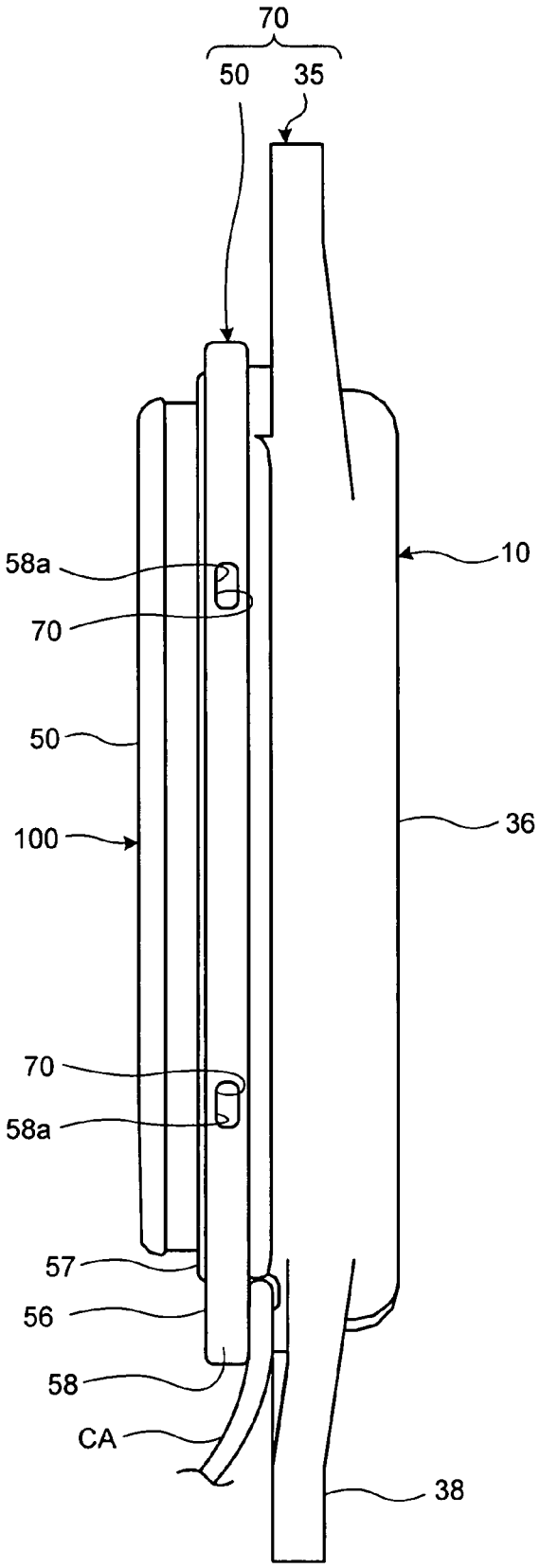
FIG. 3 is a side view of the latch-release actuating apparatus shown in FIG. 1.

The attachment portion 58 covers up a side surface 48*b* and a back surface 48*c* of the second plate member 48 shown in FIG. 7, and formed to be integral with the peripheral edge 56. As shown in FIG. 14, a second protrusion 59 is formed in a portion on an entire circumference of the attachment portion 58, the portion covering up the back surface 48*c* of the second plate member 48. The second protrusion 59 has a small-diameter semicircular cross section and is formed in the borderless state. As shown in FIG. 3, two penetrating holes 58*a* are provided to the attachment portion 58 thus configured. The penetrating holes 58*a* are arranged in portions corresponding to regions where the two breathing grooves 49 of the first plate member 47 are arranged, respectively, each being formed to have a rectangular shape.

If the lid member 100 thus configured is attached to the case 35, the retaining claw 55*a* of the key top member 52 shown in FIG. 5 is first inserted to the inside of the case 35 from one end of the opening 35*a*, thereby engaging the retaining claw 55*a* with the first retaining portion 65. Thereafter, the retaining claw 55*b* is inserted to the inside of the case 35 from the other end of the opening 35*a*, thereby engaging the other retaining claw 55*b* with the second retaining portion 66.

In a state where the retaining claw 55*a* is engaged with the first retaining portion 65 and the retaining claw 55*b* is engaged with the second retaining portion 66, the regulating unit 69 constituted by the retaining claws 55*a* and 55*b* and the first and second retaining portions 65 and 66 prevents the key top member 52 from separating from the push button 17. Besides, in this state, the pressing portion 60 abuts on the push button 17 while the switch element 15 is turned off.

Next, the attachment portion 58 of the lid member 100 is inserted between the second plate member 48 of the collar 46 and the sidewall 36*b* of the case main body 36 shown in FIG. 7, and the second protrusion 59 is fitted into each engagement groove 36*c* of the case main body 36. The latch-release actuating apparatus 10 is thereby completed.

Figure 11:
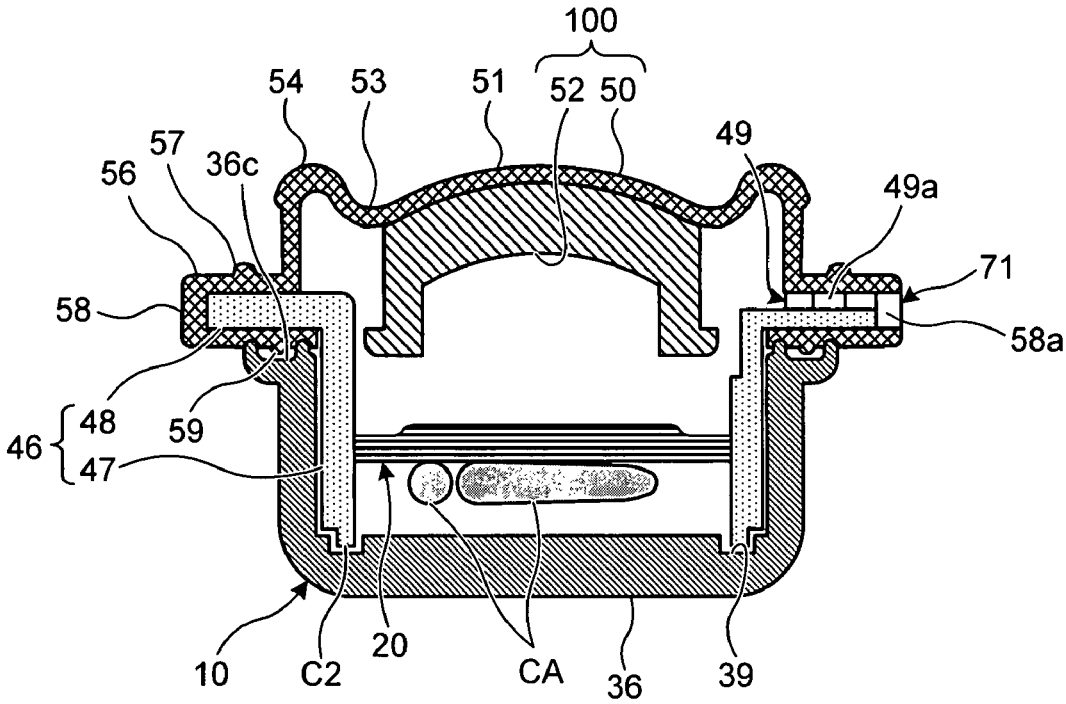
FIG. 11 is a cross-sectional view taken along a line IV-IV of FIG. 8.

As shown in FIG. 11, the latch-release actuating apparatus 10 configured as stated above includes a breathing hole 71 constituted by the breathing groove 49 of the collar 46 and the penetrating hole 58*a* of the lid member 100. The breathing hole 71 is designed to communicate the inside with the outside of the housing 70. A trap 49*a* is formed halfway along the breathing hole 71 so as to decrease an area of the breathing hole 71.

The latch-release actuating apparatus 10 in the embodiment is configured so that the protrusion length L3 of the retaining claw 55*a* is smaller than the protrusion length L4 of the retaining claw 55*b*, and so that the depth D1 of the first engagement concave portion is smaller than the depth D2 of the second engagement concave portion. Due to this, if the retaining claw 55*a* is inserted to the inside of the case 35 from the other end of the opening 35*a*, the other retaining claw 55*b* abuts on an edge of the first plate member 47 of the collar 46, and the retaining claw 55*b* cannot be inserted into the case 35. It is, therefore, possible to prevent a situation where the breathing hole 71 cannot be formed due to an error of the operator.

When a length from the center of the penetrating hole 45*a* to one end of the lip portion 54 on the upper side in FIG. 5 is L5, and a length from the center of the penetrating hole 45*b* to the other end of the lip portion 54 on the lower side in FIG. 5 is L6, the latch-release actuating apparatus 10 is configured so that the length L5 is larger than the length L6. In the latch-release actuating apparatus 10 in the embodiment, the penetrating holes 45*a* and 45*b* and the screw holes 13*a* and 13*b* constitute positioning units, respectively.

If the latch-release actuating apparatus 10 configured as stated above is attached to the attachment member 12, the operating portion 51, the groove 53, and the lip portion 54 are inserted into the attachment opening 12*b* from an inner side of the attachment member 12, and an upper portion of the peripheral edge 56 is abutted on the inside surface S1 of the attachment member 12. Then, the screw hole 13*a* is aligned to the penetrating hole 45*a*, and the screw hole 13*b* is aligned to the penetrating hole 45*b*. In this state, screws inserted into the penetrating holes 45*a* and 45*b* are engaged with the screw holes 13*a* and 13*b*, respectively, thereby attaching the latch-release actuating apparatus 10 to the attachment member 12. Thereafter, the attachment member 12 is attached to the door outer panel P of the trunk lid T. In a state where the attachment member 12 is attached to the door outer panel P, the breathing hole 71 is located below the housing 70.

In the latch-release actuating apparatus 10, the length L1 from the center of one screw hole to one end of the attachment opening 12*b* is larger than the length L2 from the center of the other screw hole to the other end of the attachment opening 12*b*, and the length L5 from the center of one penetrating hole to one end of the lip portion 54 is larger than the length L6 from the center of the other penetrating hole to the other end of the lip portion 54. Due to this, even if the operating portion 51, the groove 53, and the lip portion 54 are inserted into the attachment opening 12*b*, the screw hole 13*a* cannot be aligned to the penetrating hole 45*b*, and the screw hole 13*b* cannot be aligned to the penetrating hole 45*a*. Accordingly, it is possible to prevent the latch-release actuating apparatus 10 from being attached to the attachment member 12 while the breathing hole 71 is arranged on top of the housing 70 due to an error of the operator.

In the latch-release actuating apparatus 10 attached to the door outer panel P as stated above, when the operating portion 51 of the lid member 100 is depressed from the outside of the door outer panel P, the cover member 50 is appropriately deformed. The push button 17 of the switch element 15 is thereby depressed via the operating portion 51, thus turning on the switch element 15. Therefore, as shown in FIG. 4, if a desired cable is connected to the connector CO so that the switch element 15 serves as a release-actuator activating switch, a release actuator is driven by depressing the switch element 15, enabling the release of the latched state of the trunk lid T.

Furthermore, the groove 53 is provided between the operating portion 51 and the lip portion 54 in the latch-release actuating apparatus 10. Therefore, even if the operator cannot visually recognize the latch-release actuating apparatus 10, the operator can easily check the position of the operating portion 51 by, for example, the tactile sensation of a finger of the operator. Accordingly, as shown in FIG. 1, even if the latch-release actuating apparatus 10 is attached to the door outer panel P so as to be located on the top of the operation concave portion 12*a*, it is not necessary for the operator to perform operation while looking into the operation concave portion 12*a*.

Moreover, in the latch-release actuating apparatus 10, the key top member 52 and the cover member 50 are formed to be long so as to extend horizontally from the upper region of the push button 17, and the key top member 52 is arranged on the back surface of the cover member 50 so that the longitudinal direction of the key top member 52 coincides with that of the cover member 50. Therefore, the cover member 50 and the key top member 52 can be formed larger than the push button 17, whereby the operability of the latch-release actuating apparatus 10 attached to the door outer panel P so as to be located on the top of the operation concave portion 12*a* can be improved.

Figure 17:
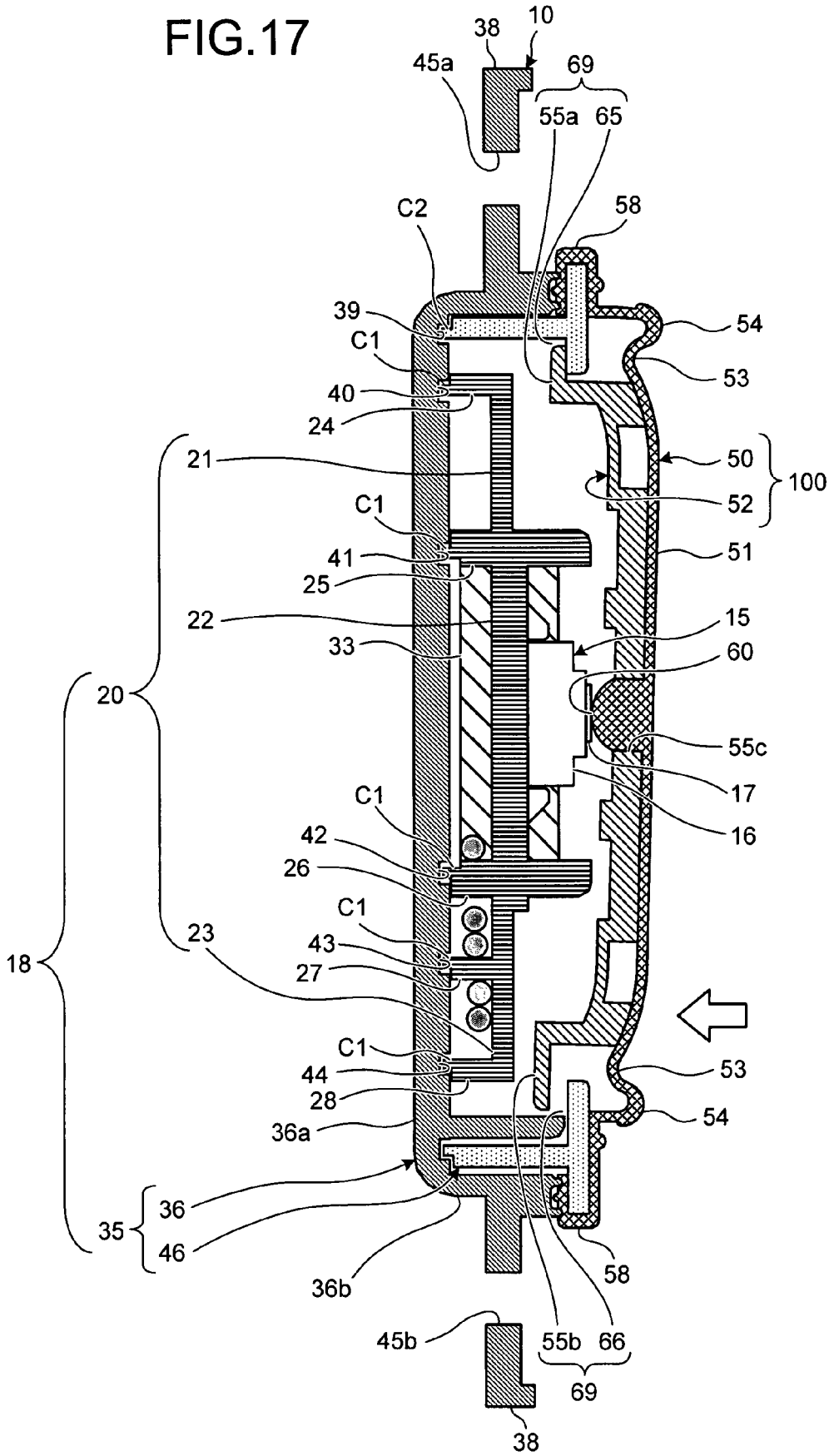
FIG. 17 is a schematic diagram illustrating an instance where one end of a key top member included in the latch-release actuating apparatus shown in FIG. 1 is operated.

Further, the latch-release actuating apparatus 10 includes, between both longitudinal ends of the key top member 52 and the base member 18, the retaining claws 55*a* and 55*b* and the retaining portions 65 and 66 to which the retaining claws 55*a* and 55*b* are retained, respectively. If the retaining claws 55*a* and 55*b* abut on the retaining portions 65 and 66, the regulating unit 69 for regulating a separation of the key top member 52 from the push button 17 is provided. Due to this, if the key top member 52 is made closer to the push button 17 via the cover member 50, the switch element 15 can be depressed. Besides, as stated above, the key top member 52 and the cover member 50 are formed to be long. Due to this, as shown in, for example, FIG. 17, if an end on the lower side of the key top member 52 is operated via the cover member 50, the key top member 52 is inclined so that the end one the lower side of the key top member 52 is closer to the base member 18 while the other end of the key top member 52 acts as a center of inclination axis. Therefore, even if the end on the lower side of the key top member 52 is operated, the push button 17 can be surely depressed against the switch main body 16. Needless to say, even if the other end on the upper side of the key top member 52 in FIG. 17 is operated, the push button 17 can be surely depressed against the switch main body 16 by the same mechanism.

Furthermore, in the latch-release actuating apparatus 10, the protrusion amount of the protection wall 30 is set so that the gap between the abutment concave portion 52*a* formed in the key top member 52 and the tip end of the protection wall 30 is smaller than the depression stroke of the switch element 15 in the state where the base member 18 and the lid member 100 constitute the housing 70. Accordingly, if the operating portion 51 of the lid member 100 is strongly pushed down, the key top member 52 of the lid member 100 abuts on the protection wall 30, whereby it is possible to regulate a depression amount of the push button 17 and to prevent a breakdown of the switch element 15.

Figure 15:
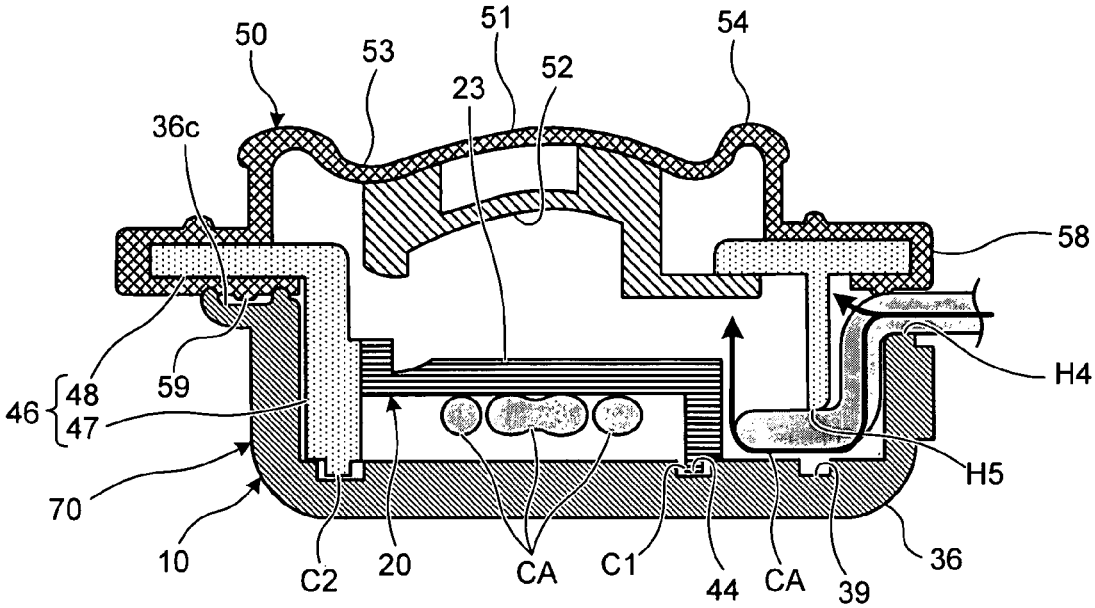
FIG. 15 is a schematic diagram for explaining a path of water entering an inside of a housing of the latch-release actuating apparatus shown in FIG. 1.
Figure 16:
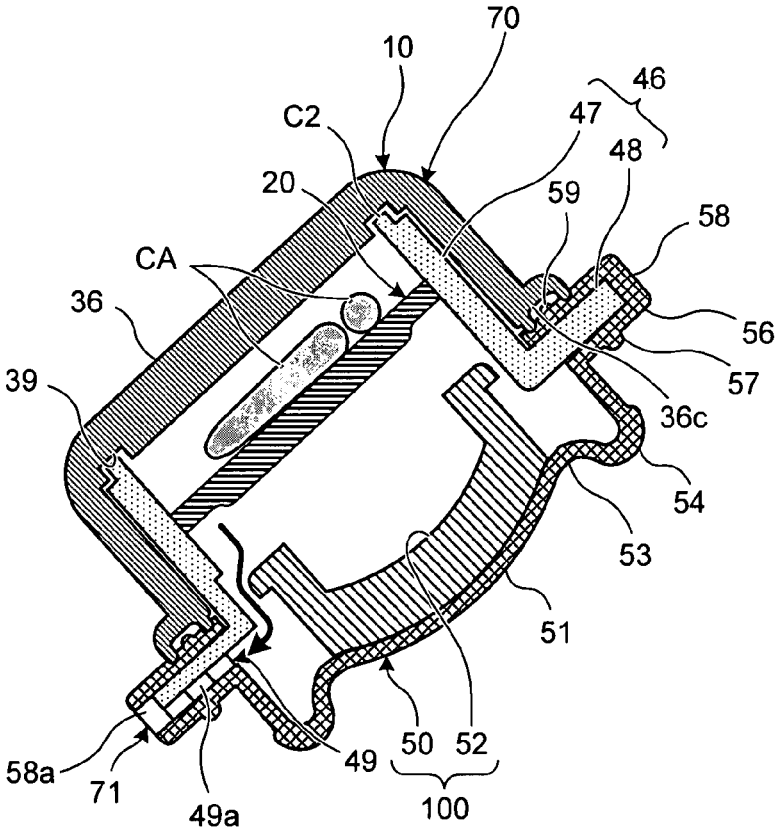
FIG. 16 is a schematic diagram for explaining a path of water entering the inside of the housing of the latch-release actuating apparatus shown in FIG. 1.

Moreover, the latch-release actuating apparatus 10 includes the seal member 33 that seals electrically-conductive portions on the front and back surfaces of the substrate 20. Due to this, as shown in, for example, FIG. 15, even if water enters inside of the housing 70 from the cut H4 of the case main body 36, the seal member 33 can prevent the electrically-conductive portions from being exposed to the water. Accordingly, the latch-release actuating apparatus 10 does not cause a malfunction owing to the exposure of the electrically-conductive portions to the water.

Further, in the latch-release actuating apparatus 10, as shown in FIG. 6, the breathing hole 71 is arranged below the housing 70 so as to discharge the water entering the housing 70 to the outside of the housing 70 by the gravitation. The water entering the housing 70 is immediately discharged to the outside of the housing 70 through the breathing hole 71. Accordingly, it is possible to prevent water from staying inside the housing 70.

Besides, in the latch-release actuating apparatus 10, the trap 49*a* for decreasing the area of the breathing hole 71 is provided halfway along the breathing hole 71. Therefore, it is possible to reduce the possibility of entry of foreign materials such as dust into the housing 70 through the breathing hole 71.

In the embodiment stated above, the switch element 15 configured so that the switch main body 16 has a substantially square and thin outer shape, and so that the push button 17 having a thin cylindrical shape protrudes from the upper surface of the switch main body 16 is employed. However, the shape and configuration of the switch element 15 are not limited to those stated in the embodiment. Nevertheless, it is preferable to employ the switch element 15 which is configured to be thin enough to make the protrusion amount of the switch element 15 from the door outer panel P as small as possible.

Moreover, in the explanation of the embodiment stated above, the retaining claws 55*a* and 55*b* are provided on the key top member 52 and the retaining portions 65 and 66 are provided on the base member 18, thereby constituting the regulating unit 69. However, the present invention is not limited to the configuration, and the retaining claws 55*a* and 55*b* may be provided on the base member 18 and the retaining portions 65 and 66 may be provided on the key top member 52.

According to the present invention, in the latch-release actuating apparatus, the key top member and the cover member are formed to be long so as to extend horizontally from the upper region of the push button, and the key top member is arranged on the back surface of the cover member so that the longitudinal direction of the key top member coincides with that of the cover member. Therefore, the cover member and the key top member can be formed larger than the push button, whereby the operability of the latch-release actuating apparatus can be improved. Furthermore, the latch-release actuating apparatus according to the present invention includes the claws and the retaining portions to which the claws are retained between the both longitudinal ends of the key top member and the base member, respectively. The claws and the retaining portions which abut with each other constitute the regulating unit for regulating the separation of the key top member from the push button. Due to this, if the key top member is made closer to the push button via the cover member, the switch element can be depressed. Besides, as stated above, the key top member and the cover member are formed to be long. Due to this, if one end of the key top member is operated via the cover member, the key top member is inclined so that the end of the key top member comes close to the base member while the other end of the key top member acts as a center of inclination axis. Therefore, even if the other end of the key top member is operated, the push button can be surely depressed against the switch main body.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A latch-release actuating apparatus comprising:

a switch element that is turned on to release a latched state of a trunk lid when a push button is depressed against a switch main body;

a base member that includes a concave portion which therein accommodates the switch element; and a cover member that has a water-tightness and covers up the concave portion, wherein the switch element is depressed via the cover member, wherein a key top member and the cover member are formed to be elongated and to extend to an upper region of the push button, wherein the key top member is arranged on a back surface of the cover member such that a longitudinal direction of the key top member coincides with a longitudinal direction of the cover member, wherein the key top member includes a first retaining claw and a second retaining claw at longitudinal ends of the key top member, wherein the base member includes a first retaining portion and a second retaining portion at longitudinal ends of the concave portion, and wherein the first retaining claw is accommodated within the first retaining portion and the second retaining claw is accommodated within the second retaining portion, such that the first retaining claw and the second retaining claw are movable in a depth direction of the concave portion and are retained not to come off the first retaining portion and the second retaining portion in the longitudinal direction, respectively.

2. The latch-release actuating apparatus according to claim 1, wherein a protrusion length of the first retaining claw insertable into the first retaining portion is smaller than a protrusion length of the second retaining claw insertable into the second retaining portion.

3. The latch-release actuating apparatus according to claim 1, wherein the first and second retaining portions are formed from a first plate member being placed orthogonal to a second plate member.

4. The latch-release actuating apparatus according to claim 3, wherein the cover member comprises attachment portions configured to cover front and side surfaces of the second plate member.

5. The latch-release actuating apparatus according to claim 3, wherein the cover member comprises attachment portions configured to cover front, back, and side surfaces of the second plate member.

6. The latch-release actuating apparatus according to claim 1, wherein the base member comprises a case main body, wherein the switch element and the key top member are enclosed within the case main body and cover member.

7. The latch-release actuating apparatus according to claim 6, wherein the first and second retaining claws are enclosed within the case main body and cover member.

8. The latch-release actuating apparatus according to claim 1, wherein the key top member is configured such that, when a first end of the key top member is operated via the cover member, the key top member is inclined such that the first end is closer to the base member while a second opposing end of the key top member acts as a central axis of inclination.

9. A latch-release actuating apparatus comprising:

a switch element comprising a push button, wherein the switch element is configured to be turned on to release a latched state of a trunk lid when the push button is depressed;

a base member comprising a concave portion having a first retaining portion at one longitudinal end of the concave portion and a second retaining portion at another longitudinal end of the concave portion, wherein the concave portion accommodates the switch element;

a cover member covering up the concave portion, wherein the switch element is configured to be depressed via the cover member; and a key top member comprising a first retaining claw at one longitudinal end of the key top member and a second retaining claw at another longitudinal end of the key top member, wherein the key top member and the cover member are formed to extend to an upper region of the push button, wherein the key top member is arranged on a back surface of the cover member such that a longitudinal direction of the key top member coincides with a longitudinal direction of the cover member, and wherein the first retaining claw is accommodated within the first retaining portion and the second retaining claw is accommodated within the second retaining portion, such that the first retaining claw and the second retaining claw are movable in a depth direction of the concave portion and are retained not to come off the first retaining portion and the second retaining portion in the longitudinal direction, respectively.

10. The latch-release actuating apparatus according to claim 9, wherein the switch element further comprises a switch main body, and wherein the switch element is configured to be turned on to release the latched state of the trunk lid when the push button is depressed against the switch main body.

11. The latch-release actuating apparatus according to claim 9, wherein a protrusion length of the first retaining claw insertable into the first retaining portion is smaller than a protrusion length of the second retaining claw insertable into the second retaining portion.

12. The latch-release actuating apparatus according to claim 9, wherein the first and second retaining portions are formed from a first plate member being placed orthogonal to a second plate member.

13. The latch-release actuating apparatus according to claim 12, wherein the cover member comprises attachment portions configured to cover front and side surfaces of the second plate member.

14. The latch-release actuating apparatus according to claim 12, wherein the cover member comprises attachment portions configured to cover front, back, and side surfaces of the second plate member.

15. The latch-release actuating apparatus according to claim 9, wherein the base member comprises a case main body, wherein the switch element and the key top member are enclosed within the case main body and cover member.

16. The latch-release actuating apparatus according to claim 15, wherein the first and second retaining claws are enclosed within the case main body and cover member.

17. The latch-release actuating apparatus according to claim 9, wherein the key top member is configured such that, when a first end of the key top member is operated via the cover member, the key top member is inclined such that the first end is closer to the base member while a second opposing end of the key top member acts as a central axis of inclination.

* * * * *